US009121080B2

(12) United States Patent
Oura et al.

(10) Patent No.: US 9,121,080 B2
(45) Date of Patent: Sep. 1, 2015

(54) HIGH-CARBON STEEL WIRE EXCELLENT IN WIRE DRAWABILITY AND FATIGUE PROPERTY AFTER WIREDRAWING

(75) Inventors: Hiroshi Oura, Kobe (JP); Nao Yoshihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 310 days.

(21) Appl. No.: 13/638,722

(22) PCT Filed: Mar. 17, 2011

(86) PCT No.: PCT/JP2011/056363

§ 371 (c)(1),
(2), (4) Date: Oct. 1, 2012

(87) PCT Pub. No.: WO2011/125447

PCT Pub. Date: Oct. 13, 2011

(65) Prior Publication Data

US 2013/0022491 A1 Jan. 24, 2013

(30) Foreign Application Priority Data

Apr. 1, 2010 (JP) ..... 2010-085581

(51) Int. Cl.

| | |
|---|---|
| ***C22C 38/00*** | (2006.01) |
| ***C21D 8/06*** | (2006.01) |
| ***C22C 38/02*** | (2006.01) |
| ***C22C 38/32*** | (2006.01) |
| ***C22C 38/16*** | (2006.01) |
| ***C22C 38/06*** | (2006.01) |

(52) U.S. Cl.

CPC *C21D 8/06* (2013.01); *C21D 8/065* (2013.01); *C22C 38/001* (2013.01); *C22C 38/002* (2013.01); *C22C 38/02* (2013.01); *C22C 38/06* (2013.01); *C22C 38/16* (2013.01); *C22C 38/32* (2013.01); *C21D 2211/004* (2013.01); *C21D 2211/009* (2013.01)

(58) Field of Classification Search

CPC ..... C22C 38/02; C22C 38/32; C22C 38/16; C22C 38/20; C22C 38/04; C22C 38/06

USPC ..... 148/598, 330, 595; 420/90, 99, 121, 89

See application file for complete search history.

(56) References Cited

U.S. PATENT DOCUMENTS

| | | | | |
|---|---|---|---|---|
| 6,447,622 | B1 | 9/2002 | Yamada et al. | |
| 6,645,319 | B2 | 11/2003 | Nagao et al. | |
| 6,800,147 | B2 | 10/2004 | Nagao et al. | |
| 8,142,577 | B2 * | 3/2012 | Yamasaki et al. ..... | 148/598 |
| 2006/0048864 | A1 | 3/2006 | Nagao et al. | |
| 2007/0277913 | A1 | 12/2007 | Kochi et al. | |

FOREIGN PATENT DOCUMENTS

| | | | |
|---|---|---|---|
| CN | 101208445 | A | 6/2008 |
| EP | 1 577 410 | A1 | 9/2005 |
| EP | 1 865 079 | A1 | 12/2007 |
| JP | 6 340950 | | 12/1994 |
| JP | 7 258787 | | 10/1995 |
| JP | 2002 146479 | | 5/2002 |
| JP | 3294245 | | 6/2002 |
| JP | 2003 82437 | | 3/2003 |
| JP | 2004 137597 | | 5/2004 |
| JP | 2005 163082 | | 6/2005 |
| JP | 2007 327084 | | 12/2007 |
| JP | 2008 261028 | | 10/2008 |
| WO | WO 2004/029315 | A1 | 4/2004 |
| WO | WO 2007001054 | A1 * | 1/2007 |

OTHER PUBLICATIONS

International Search Report Issued Jun. 14, 2012 in PCT/JP11/56363 Filed Mar. 17, 2011.

Combined Chinese Office Action and Search Report issued Aug. 30, 2013 in Patent Application No. 201180012852.7 (with English language translation).

International Search Report issued Jun. 14, 2011 in PCT/JP2011/056363 with English language translation.

* cited by examiner

*Primary Examiner* — Roy King
*Assistant Examiner* — Jenny Wu
(74) *Attorney, Agent, or Firm* — Oblon, McClelland, Maier & Neustadt, L.L.P.

(57) ABSTRACT

Provided is a high-carbon steel wire which gives steel wires having high strength and has excellent suitability for wire-drawing and which after being wiredrawn, has excellent fatigue properties. The high-carbon steel wire has an adequately regulated chemical composition and has a pearlite structure in an areal proportion of 90% or more. In 2,000 $\mu m^2$ of the pearlite structure, the number of BN compound grains having an equivalent-circle diameter of 100 nm or more but less than 1,000 nm is 100 or less (including 0) and the number of BN compound grains having an equivalent-circle diameter of 1,000 nm or more is 10 or less (including 0).

20 Claims, No Drawings

HIGH-CARBON STEEL WIRE EXCELLENT IN WIRE DRAWABILITY AND FATIGUE PROPERTY AFTER WIREDRAWING

This application is a 371 of PCT/JP2011/056363, filed Mar. 17, 2011. Priority to Japanese patent application 2010-085581, filed Apr. 1, 2010, is claimed.

TECHNICAL FIELD

The present invention relates: to a high-carbon steel wire used for steel cord, saw wire for semiconductor cutting, hose wire, etc.; and in particular to a high-carbon steel wire having improved wire drawability and fatigue properties after wiredrawing.

BACKGROUND ART

A high-carbon steel wire used for steel cord, saw wire for semiconductor cutting, hose wire, etc. is required to have a good wire drawability from the viewpoint of productivity in addition to a high strength and high fatigue properties. In this context, various steel wire rods and steel wires of high qualities conforming to the above requirements have heretofore been developed.

For example, Patent Literature 1 proposes a technology of improving the wire drawability and fatigue properties of a hard steel wire for cold drawing by forming tempered lower bainite in a structure before wiredrawing. According to the technology, excellent wire drawability and fatigue properties after wiredrawing are materialized by drawing a lower bainite structure that is considered to be suitable for wiredrawing from the shape of carbide. The work hardenability of a bainite structure is lower than that of a pearlite structure however and a final wire strength is only about 3,500 MPa.

Further, Patent Literature 2 proposes a technology of improving wire drawability and fatigue resistance after wiredrawing by controlling a total oxygen quantity and the composition and number of inviscid inclusions. By the technology however, a fatigue limit stress to a tensile strength is only about 0.3 and fatigue properties are not necessarily exhibited sufficiently.

Patent Literature 3 discloses a technology of improving the fatigue properties of a high-strength wire by controlling the aspect ratio of inclusions in the steel wire. According to the technology however, a fatigue limit stress to a tensile strength is about 0.3 at the most and a sufficiently high fatigue strength is not yet obtained like Patent Literature 2.

Patent Literature 4 discloses a technology of improving the strain aging embrittlement resistance of a high-strength high-carbon steel wire by forming amorphous cementite as lamellar cementite in the pearlite structure of the wire and controlling the strength of the wire in a range stipulated by a wire diameter and a carbon quantity. By the technology, it is possible to produce a thin high-strength high-carbon steel wire having an improved longitudinal crackability but satisfactory high strength and high fatigue strength are not obtained yet.

Meanwhile, Patent Literature 5 proposes a technology of improving wire drawability and twistability by controlling the size of a pearlite nodule and the maximum length of secondary phase ferrite. By the technology, it is possible to obtain a high-strength high-carbon steel wire excellent in wire drawability but satisfactory high strength and high fatigue strength are not obtained yet.

CITATION LIST

Patent Literature

Patent Literature 1: JP-A No. H07-258787
Patent Literature 2: JP No. 3294245
Patent Literature 3: JP-A No. H06-340950
Patent Literature 4: JP-A No. 2003-82437
Patent Literature 5: JP-A No. 2002-146479

DISCLOSURE OF THE INVENTION

Problem to be Solved by the Invention

The present invention has been established in order to solve the problems of the existing technologies and an object of the present invention is to provide a high-carbon steel wire having a high strength as a steel wire, an excellent wire drawability, and excellent fatigue properties after wiredrawing.

Means for Solving the Problem

A high-carbon steel wire according to the present invention that has solved the above problems is characterized in that: the steel wire contains C, 0.70%-1.20% (in terms of "mass %", the same is applied to chemical components hereunder), Si: 0.1%-1.5%, Mn: 0.1%-1.5%, P: 0.015% or less (not including 0%), S: 0.015% or less (not including 0%), Al: 0.005% or less (not including 0%), B: 0.0005%-0.010%, N: 0.002%-0.005%, and solid solution N: 0.0015% or less (including 0%), with the balance consisting of iron and unavoidable impurities; the area ratio of a pearlite structure is 90% or more; and, in a pearlite structure of 2,000 $\mu m^2$, the number of BN-system compound grains having equivalent circle diameters of 100 nm or more to less than 1,000 nm is not more than 100 pieces (including 0 piece) and the number of BN-system compound grains having equivalent circle diameters of 1,000 nm or more is not more than 10 pieces (including 0 piece).

In the present invention here, an "equivalent circle diameter" means the diameter of a circle having an area identical to the size of a BN-system compound. Then the term "BN-system compound" cited in the present invention is a substance having BN as the main component but is allowed to include a BN-system compound having MnS as the nucleus.

It is effective that a high-carbon steel wire according to the present invention further contains (a) Cu: 0.25% or less (not including 0%), (b) Cr: 1.0% or less (not including 0%), and the like, if necessary and, by containing those elements, the properties of the high-carbon steel wire are improved further in accordance with the kinds of the elements.

Effect of the Invention

In the present invention, it is possible to materialize a high-strength high-carbon steel wire excellent in wire drawability and fatigue properties after wiredrawing by adjusting a chemical composition appropriately, adjusting the area ratio of a pearlite structure, and stipulating the number of BN-system compound grains contained in the pearlite structure in accordance with the size and such a high-carbon steel wire is very useful as a raw material for steel cord, saw wire for semiconductor cutting, hose wire, etc.

BEST MODE FOR CARRYING OUT THE INVENTION

The present inventors have studied from various aspects in order to improve the wire drawability and fatigue properties after wiredrawing of a high-strength high-carbon steel wire. As a result, the following knowledge is obtained. That is, the present inventors have: found that, although wire drawability and fatigue properties deteriorate when cold wire drawing is applied strongly to a pearlite structure, it is possible to inhibit wire drawability and fatigue properties from deteriorating and exhibit excellent properties by controlling the area ratio of a pearlite structure before wiredrawing to 90% or more, fixing and reducing solid solution N by B, and micronizing precipitated BN-system compound grains so that, in a pearlite structure of 2,000 $\mu m^2$, the number of BN-system compound grains having equivalent circle diameters of 100 nm or more to less than 1,000 nm may be not more than 100 pieces (including 0 piece) and the number of BN-system compound grains having equivalent circle diameters of 1,000 nm or more may be not more than 10 pieces (including 0 piece); and completed the present invention.

Important requirements of a high-carbon steel wire according to the present invention are (a) a solid solution N quantity is stipulated, (b) a pearlite area ratio in a structure before wiredrawing is stipulated, and (c) the size and number of precipitated BN-system compound grains are controlled in prescribed ranges. That is, it is possible to inhibit aging embrittlement during and after wiredrawing by precipitating solid solution N causing aging embrittlement as a BN-system compound during wiredrawing. Further, it is possible to inhibit aging embrittlement during wiredrawing caused by pro-eutectoid ferrite by controlling a pearlite area ratio in a structure before wiredrawing to 90% or more. Then in a wire according to the present invention, it is important to precipitate fine BN-system compound grains having equivalent circle diameters of less than 100 nm in a pearlite phase and BN-system compound grains having equivalent circle diameters of not less than 100 nm adversely affect wire drawability and fatigue properties. Consequently, although it is desirable that BN-system compound grains having equivalent circle diameters of not less than 100 nm do not exist, the influence can be minimized by restricting BN-system compound grains in the ranges stipulated in the present invention.

The reasons why the requirements such as a pearlite area ratio and the precipitation form (precipitation size and number) of BN-system compound grains are stipulated in a high-carbon steel wire according to the present invention are as follows.

[Area Ratio of Pearlite Structure: 90% or More]

A high-carbon steel wire according to the present invention has a pearlite structure as the main phase. Although a structure comprising a pro-eutectoid ferrite phase and a bainite phase is included besides a perlite structure, if such a structure increases, work hardenability deteriorates. For that reason, the area ratio of a pearlite structure has to be 90% or more and preferably 93% or more.

[Precipitation Form of BN-System Compound]

It is possible to improve the wire drawability and fatigue strength of a wire by adjusting a heating temperature before blooming and a cooling rate after the commencement of the blooming (described later) and micronizing the equivalent circle diameters of precipitated BN-system compound grains to less than 100 nm. Although it is desirable that BN-system compound grains having equivalent circle diameters of 100 nm or more do not exist, it is possible to minimize the influence by restricting BN-system compound grains having equivalent circle diameters of not less than 100 nm in the range stipulated in the present invention and hence the precipitation form of BN-system compound grains having equivalent circle diameters of not less than 100 nm is stipulated as follows in accordance with the size.

(Number of BN-system compound grains having equivalent circle diameters of 100 or more to less than 1,000 nm is not more than 100 pieces (including 0 piece) in a pearlite structure of 2,000 $\mu m^2$)

It is effective for improving wire drawability and fatigue strength to micronize precipitated BN-system compound grains by fixing N and the BN-system compound grains have to be controlled to sizes in a prescribed range. It is possible to improve wire drawability and fatigue strength by controlling the sizes of comparatively fine BN-system compound grains to equivalent circle diameters of 100 or more to less than 1,000 nm and the number thereof to not more than 100 pieces and preferably not more than 70 pieces (including 0 piece) in a pearlite structure of 2,000 $\mu m^2$.

(Number of BN-system compound grains having equivalent circle diameters of 1,000 nm or more is not more than 10 pieces (including 0 piece) in a pearlite structure of 2,000 $\mu m^2$)

In a high-carbon steel wire according to the present invention, it is also important to inhibit BN-system compound grains of relatively large sizes having equivalent circle diameters of 1,000 nm or more from precipitating. Wire drawability and fatigue strength deteriorate considerably when the number of such precipitated BN-system compound grains increases and hence it is possible to improve wire drawability and fatigue strength by controlling the number of the precipitated BN-system compound grains to not more than 10 pieces and preferably not more than 7 pieces (including 0 piece) in a pearlite structure of 2,000 $\mu m^2$.

In a high-carbon steel wire according to the present invention, the chemical composition thereof has to be adjusted appropriately. The reason for limiting the range of each of components (elements), including the quantity of solid solution N stated above, in the chemical composition is as follows.

[C: 0.70%-1.20%]

C is an economical and effective strengthening element and the degree of work hardening during wiredrawing and strength after wiredrawing increase in proportion to the increase of a C content. When a C content is less than 0.70%, a pearlite structure of 90% or more in area ratio is hardly obtained. When a C content is excessive in contrast, not only a net-shaped pro-eutectoid cementite phase is generated at austenite grain boundaries and wire breakage tends to occur during wiredrawing but also the toughness and ductility of an ultrathin wire after final wiredrawing deteriorate considerably. Consequently, a C content is set at 0.70%-1.20% and preferably 0.75%-1.15%.

[Si: 0.1%-1.5%]

Si is an element necessary for deoxidizing a steel. Further, Si dissolves in a ferrite phase in a pearlite structure and has the effect of increasing strength after patenting. When a Si content is as small as less than 0.1%, the effects of deoxidation and strength enhancement are insufficient and hence the lower limit is set at 0.1%. When an Si content is excessive in contrast, the ductility of a ferrite phase in a pearlite structure and the ductility of an ultrathin wire after wiredrawing deteriorate and hence the upper limit thereof is set at 1.5%. A preferable Si content is 0.15%-1.4%.

[Mn: 0.1%-1.5%]

Mn is an element useful as an deoxidizer in the same way as Si. Further, Mn is effective for enhancing the strength of a wire. Furthermore, Mn has the effects of enhancing the hardenability of a steel and reducing pro-eutectoid ferrite in a rolled material. An Mn content has to be 0.1% or more in order to exhibit the effects. Mn is an element likely to segregate however and, when an Mn content exceeds 1.5%, Mn segregates particularly in the center of a wire, martensite and bainite are generated in the segregated part, and hence wire drawability deteriorates. Consequently, an Mn content is set at 0.1%-1.5% and preferably 0.2%-1.4%.

[P: 0.015% Or Less (not Including 0%)]

P is an unavoidable impurity and the smaller, the better. In particular, P segregates at grain boundaries, causes embrittlement to be generated, and hence largely influences the deterioration of wire drawability. Consequently in the present invention, P is set at 0.015% or less and preferably 0.01% or less.

[S: 0.015% Or Less (not Including 0%)]

S is an unavoidable impurity and the smaller, the better. In particular, S segregates at grain boundaries, causes embrittlement to be generated, and hence largely influences the deterioration of wire drawability. Consequently in the present invention, S is set at 0.015% or less and preferably 0.01% or less.

[Al: 0.005% or Less (not Including 0%)]

Al is effective as a deoxidizing element but generates a hard non-deforming alumina system nonmetallic inclusion ($Al_2O_3$). The nonmetallic inclusion hinders the ductility of an ultrathin wire and wire drawability considerably. Consequently in a steel wire according to the present invention, Al has to be set at 0.005% or less and preferably 0.003% or less.

[B: 0.0005%-0.010%]

B is an element effective for improving the drawability of a wire and fatigue properties after wiredrawing by finely precipitating solid solution N as a BN-system compound. A B content has to be 0.0005% or more in order to precipitate a BN-system compound sufficiently. When B is contained in excess of 0.010% however, a BN-system compound tends to coarsen and deteriorates fatigue strength. In the present invention, a B content is set at 0.0005%-0.010% and preferably 0.002%-0.008%. Further, pro-eutectoid ferrite is inhibited from being generated effectively by changing a part of B into solid solution B and a value obtained by dividing a B addition quantity by an N addition quantity is preferably 0.9 or more and yet preferably 1.0 or more.

[N: 0.002%-0.005% (Here, Solid Solution N is 0.0015% Or Less)]

N causes embrittlement during wiredrawing in a solid solution state and deteriorates wire drawability. Consequently, it is necessary to precipitate a BN-system compound by B and control solid solution N to 0.0015% or less. The following expression (1) should be satisfied in order to control solid solution N to 0.0015% or less, $$B-(N-0.0015)\times 0.77\geq 0.0000 \quad (1).$$

Here, B and N represent the quantities of added B and N, respectively.

Meanwhile, when N is contained excessively, fixation by B is insufficient and solid solution N increases. Consequently, the upper limit of N is set at 0.005% and preferably 0.0045%. On the other hand, it is not realistic to control an N content to less than 0.002% from the viewpoint of production cost and hence the lower limit thereof is set at 0.002% or more.

The basic components in a high-carbon steel wire according to the present invention are as stated above and the balance consists of iron and unavoidable impurities (impurities other than P and S stated above). As unavoidable impurities, elements brought in in accordance with the situations of raw materials, materials, production equipment, etc. are acceptable. Further, in a high-carbon steel wire according to the present invention, it is also useful to further contain (a) Cu: 0.25% or less (not including 0%), (b) Cr: 1.0% or less (not including 0%), and the like, if necessary, and the properties of the high-carbon steel wire improve further by containing the elements in accordance with the kinds of the elements.

[Cu: 0.25% Or Less (not Including 0%)]

Cu is an element effective for enhancing the corrosion resistance of a steel wire, improving scale removability during mechanical descaling (MD), and preventing troubles such as seizure of a die. When Cu is contained excessively however, even in the case of controlling a wire retention temperature after hot rolling to a high temperature of about 900° C., blisters are generated on the surface of a wire, magnetite is formed under the blisters in the steel mother material, and hence the MD property deteriorates. Further, Cu reacts with S and segregates CuS at grain boundaries and hence defects are generated in a steel ingot, a wire, etc. during the wire production processes. In order to prevent such harmful influences, a Cu content is set preferably at 0.25% or less and yet preferably at 0.03%-0.23%.

[Cr: 1.0% Or Less (not Including 0%)]

Cr is effective for micronizing lamellar intervals of pearlite and improving the strength and drawability of a wire. When a Cr content is excessive however, undissolved cementite tends to be generated, transformation termination time increases, supercooled structures of martensite, bainite, etc. are likely to be formed in a hot-rolled wire, and the MD property also deteriorates. Consequently, preferably the upper limit of Cr is 1.0% or less and yet preferably a Cr content is 0.03%-0.8%.

When a high-carbon steel wire according to the present invention is produced by controlling the form of a BN-system compound as stated above, it is necessary to control a heating temperature at blooming and a cooling rate thereafter in a cast steel having such a chemical composition as stated above. That is, it is effective to control a heating temperature before blooming to 1,300° C. or higher and a cooling rate after the commencement of the blooming to 0.5° C./sec. or more in the temperature range of 1,300° C.-1,100° C.

It is possible to: sufficiently dissolve a BN-system compound in a steel by controlling a heating temperature before blooming to 1,300° C. or higher; and successively control, in a pearlite structure of 2,000 $\mu m^2$, the number of BN-system compound grains having equivalent circle diameters of 100 nm or more to less than 1,000 nm to not more than 100 pieces and the number of BN-system compound grains having equivalent circle diameters of 1,000 nm or more to not more than 10 pieces by controlling a cooling rate after the commencement of the blooming to 0.5° C./sec. or more in the temperature range of 1,300° C.-1,100° C. By so doing, a high-carbon steel wire excellent in wire drawability and fatigue properties after wiredrawing can be materialized.

In a high-carbon steel wire according to the present invention, the area ratio of a pearlite structure is 90% or more and such a structure can be obtained by controlling a coiling temperature after hot rolling and a cooling rate thereafter. That is, it is necessary to: control a coiling temperature after hot rolling to 850° C. or higher to 950° C. or lower; and successively apply cooling (for example, Stelmor air blast cooling) so that a cooling rate up to 600° C. may be 10-35° C./sec.

A coiling temperature after hot rolling has to be controlled to 850° C. or higher so that the load on a rolling mill may not be excessive but it is possible to control recrystallization and grain growth and micronize nodules by controlling a coiling temperature to 950° C. or lower. A cooling rate thereafter up to 600° C. has to be set at 10° C./sec. or more in order to inhibit pro-eutectoid ferrite and at 35° C./sec. or less so as not to generate martensite and bainite structures by rapid cooling.

EXAMPLES

Although the present invention is hereunder explained more specifically in reference to examples, of course the present invention is not restricted by the examples and can be modified appropriately within a range conforming to antero-posterior tenors and the modifications are all included in the technological scope of the present invention.

Example 1

Steels (steel types A-T and A1-N1) having chemical compositions shown in Tables 1 and 2 below are tapped from a converter, successively refined by secondary refining treatment, and casted by a continuous casting method, and thereby cast steels are produced. Here, the quantities of solid solution N shown in Tables 1 and 2 are measured by the following method.

[Measurement Method of Solid Solution N Quantity]

A value of a "solid solution N quantity" in a steel according to the present invention is computed by subtracting a total N compound quantity from a total N quantity in the steel. (a) A total N quantity in a steel is obtained by using an inert gas melting method-thermal conductivity method in conformity with JIS G1228. A sample is cut out from a steel specimen, the sample is put into a crucible and melted in an inert gas flow, N is extracted, the sample is transferred to a thermal conductivity cell, and the variation of the thermal conductivity is measured. (b) A total N compound quantity in a steel is obtained by using ammonium distillation separation indophenol blue absorption spectrometry. A sample is cut out from a steel specimen and subjected to constant-current electrolysis in a 10% AA-system electrolyte (an electrolyte of a non-aqueous solvent type that does not generate a passivation film on a steel surface and specifically 10% acetylacetone, 10% tetramethylammonium chloride, and the balance: methanol). The sample of about 0.5 g is dissolved and the undissolved residue (the N compound) is filtered with a filter of 0.1 μm in pore size comprising polycarbonate. The undissolved residue is heated and decomposed in sulfuric acid, potassium sulfate, and pure Cu chips and mixed with a filtrate. The solution is alkalified by sodium hydroxide, successively steam distillation is applied, and distilled ammonia is absorbed in dilute sulfuric acid. A blue complex is generated by adding phenol, sodium hypochlorite, and sodium pentacyanonitrosyl ferrate (III) and the absorbance is measured with a photometer.

A solid solution N quantity in a steel is computed by subtracting a total N compound quantity from a total N quantity in the steel obtained by the above methods.

TABLE 1

| Steel type | Chemical composition (mass %) | | | | | | | | | | Solid solution N quantity |
|---|---|---|---|---|---|---|---|---|---|---|---|
| | C | Si | Mn | P | S | Cu | Cr | Al | B | N | |
| A | 0.72 | 0.18 | 0.52 | 0.007 | 0.003 | — | — | 0.003 | 0.0040 | 0.0031 | 0.0004 |
| B | 0.73 | 0.30 | 0.46 | 0.005 | 0.005 | — | — | 0.001 | 0.0045 | 0.0027 | 0.0010 |
| C | 0.81 | 0.24 | 0.43 | 0.005 | 0.004 | — | 0.34 | 0.005 | 0.0040 | 0.0030 | 0.0005 |
| D | 0.82 | 0.72 | 0.81 | 0.005 | 0.006 | — | — | 0.002 | 0.0071 | 0.0029 | 0.0005 |
| E | 0.83 | 0.26 | 0.44 | 0.004 | 0.004 | 0.06 | — | 0.003 | 0.0038 | 0.0025 | 0.0006 |
| F | 0.92 | 0.25 | 0.21 | 0.005 | 0.004 | — | 0.71 | 0.002 | 0.0021 | 0.0021 | 0.0000 |
| G | 0.93 | 0.15 | 0.38 | 0.005 | 0.005 | — | — | 0.002 | 0.0030 | 0.0022 | 0.0004 |
| H | 0.91 | 0.23 | 0.31 | 0.004 | 0.005 | — | 0.21 | 0.002 | 0.0035 | 0.0021 | 0.0007 |
| I | 0.91 | 0.17 | 0.71 | 0.004 | 0.006 | 0.07 | 0.22 | 0.003 | 0.0045 | 0.0031 | 0.0006 |
| J | 0.97 | 0.20 | 0.33 | 0.005 | 0.003 | — | — | 0.002 | 0.0046 | 0.0031 | 0.0007 |
| K | 1.03 | 1.21 | 0.31 | 0.003 | 0.005 | — | — | 0.001 | 0.0023 | 0.0022 | 0.0001 |
| L | 1.04 | 0.19 | 0.37 | 0.007 | 0.005 | — | — | 0.001 | 0.0045 | 0.0027 | 0.0007 |
| M | 1.05 | 0.33 | 0.66 | 0.005 | 0.005 | — | — | 0.002 | 0.0081 | 0.0025 | 0.0004 |
| N | 1.05 | 0.38 | 0.48 | 0.006 | 0.004 | — | 0.57 | 0.002 | 0.0041 | 0.0028 | 0.0008 |
| O | 1.05 | 0.20 | 0.31 | 0.001 | 0.005 | 0.21 | — | 0.002 | 0.0036 | 0.0034 | 0.0001 |
| P | 1.06 | 0.22 | 1.25 | 0.001 | 0.004 | — | — | 0.003 | 0.0034 | 0.0028 | 0.0003 |
| Q | 1.11 | 0.16 | 0.38 | 0.006 | 0.003 | — | 0.15 | 0.003 | 0.0030 | 0.0027 | 0.0002 |
| R | 1.10 | 0.15 | 0.46 | 0.006 | 0.001 | — | — | 0.004 | 0.0041 | 0.0026 | 0.0004 |
| S | 1.15 | 0.24 | 0.48 | 0.005 | 0.005 | 0.07 | 0.22 | 0.003 | 0.0034 | 0.0026 | 0.0005 |
| T | 1.05 | 0.21 | 0.52 | 0.007 | 0.003 | 0.07 | — | 0.002 | 0.0020 | 0.0022 | 0.0003 |

* Remainder: iron and unavoidable impurities other than P and S

TABLE 2

| Steel type | Chemical composition (mass %) | | | | | | | | | | Solid solution N quantity |
|---|---|---|---|---|---|---|---|---|---|---|---|
| | C | Si | Mn | P | S | Cu | Cr | Al | B | N | |
| A1 | 1.40 | 0.15 | 0.53 | 0.005 | 0.006 | — | — | 0.003 | 0.0039 | 0.0030 | 0.0005 |
| B1 | 0.55 | 0.28 | 0.33 | 0.004 | 0.003 | — | — | 0.002 | 0.0041 | 0.0028 | 0.0004 |
| C1 | 0.82 | 1.62 | 0.30 | 0.006 | 0.003 | — | — | 0.002 | 0.0035 | 0.0026 | 0.0003 |
| D1 | 0.83 | 0.35 | 0.46 | 0.006 | 0.005 | — | — | 0.002 | — | 0.0031 | 0.0025 |
| E1 | 0.93 | 0.23 | 1.73 | 0.006 | 0.003 | — | — | 0.002 | 0.0025 | 0.0024 | 0.0001 |
| F1 | 0.92 | 0.22 | 0.20 | 0.031 | 0.005 | — | — | 0.002 | 0.0071 | 0.0028 | 0.0007 |
| G1 | 0.91 | 0.38 | 0.38 | 0.004 | 0.026 | — | — | 0.002 | 0.0035 | 0.0021 | 0.0004 |
| H1 | 0.91 | 0.15 | 0.70 | 0.005 | 0.004 | — | — | 0.035 | 0.0046 | 0.0033 | 0.0005 |
| I1 | 0.97 | 0.30 | 0.19 | 0.005 | 0.003 | — | — | 0.004 | 0.0142 | 0.0027 | 0.0000 |
| J1 | 0.97 | 0.31 | 0.29 | 0.005 | 0.005 | — | — | 0.004 | — | 0.0031 | 0.0026 |
| K1 | 0.97 | 0.22 | 0.26 | 0.006 | 0.006 | — | — | 0.003 | 0.0035 | 0.0138 | 0.0110 |
| L1 | 0.82 | 0.23 | 0.35 | 0.003 | 0.003 | — | — | 0.003 | 0.0045 | 0.0037 | 0.0004 |
| M1 | 0.92 | 0.15 | 0.31 | 0.004 | 0.006 | — | — | 0.002 | 0.0038 | 0.0031 | 0.0002 |
| N1 | 1.05 | 0.18 | 0.33 | 0.005 | 0.005 | — | — | 0.003 | 0.0041 | 0.0034 | 0.0003 |

* Remainder: iron and unavoidable impurities other than P and S

With regard to each of the cast steels of the various steel types, a heating temperature before blooming, a cooling rate (cooling rate at 1,300° C.-1,100° C.) after blooming commencement, a coiling temperature (coiling temperature at rolling) after hot rolling, and a cooling rate up to 600° C. after coiling (cooling rate after coiling) are controlled as shown in Tables 3, 4, and 5 below. Further, with regard to each of the wires (hot-rolled wires) obtained by hot-rolling (it will be described later) the cast steels after blooming, a pearlite area ratio and the form of BN-system compound grains (size and number) are measured by the following methods. The results are described in Tables 3, 4, and 5 below.

TABLE 3

| Test No. | Steel type | Heating temperature (° C.) before blooming | Cooling rate (° C./sec.) in 1,300° C.-1,100° C. | Coiling temperature (° C.) at rolling | Cooling rate (° C./sec) after coiling | Pearlite area ratio (%) | BN-system compound grain number (pieces) 100 nm or more, less than 1,000 nm | BN-system compound grain number (pieces) 1,000 nm or more |
|---|---|---|---|---|---|---|---|---|
| 1 | A | 1330 | 1.1 | 920 | 31 | 94 | 25 | 0 |
| 2 | B | 1316 | 2.5 | 929 | 19 | 93 | 38 | 0 |
| 3 | C | 1316 | 1.7 | 909 | 28 | 98 | 32 | 6 |
| 4 | D | 1330 | 0.9 | 912 | 13 | 97 | 61 | 1 |
| 5 | E | 1322 | 1.1 | 913 | 19 | 100 | 30 | 2 |
| 6 | F | 1328 | 0.9 | 883 | 15 | 95 | 41 | 0 |
| 7 | G | 1318 | 3.1 | 928 | 24 | 98 | 18 | 1 |
| 8 | H | 1326 | 2.1 | 927 | 20 | 99 | 21 | 0 |
| 9 | I | 1326 | 1.1 | 919 | 23 | 100 | 43 | 4 |
| 10 | J | 1328 | 0.9 | 932 | 32 | 99 | 12 | 3 |
| 11 | K | 1306 | 1.1 | 930 | 25 | 98 | 7 | 2 |
| 12 | L | 1304 | 1.6 | 913 | 33 | 100 | 46 | 0 |
| 13 | M | 1314 | 0.9 | 920 | 24 | 99 | 81 | 1 |
| 14 | N | 1325 | 2.4 | 917 | 19 | 100 | 28 | 1 |
| 15 | O | 1317 | 1.1 | 902 | 24 | 100 | 28 | 1 |
| 16 | P | 1326 | 0.7 | 920 | 26 | 99 | 19 | 0 |
| 17 | Q | 1330 | 1.9 | 918 | 34 | 100 | 31 | 2 |
| 18 | R | 1317 | 1.6 | 930 | 31 | 99 | 15 | 1 |
| 19 | S | 1307 | 1.0 | 932 | 32 | 98 | 58 | 1 |
| 20 | T | 1320 | 1.5 | 924 | 30 | 99 | 35 | 0 |

TABLE 4

| Test No. | Steel type | Heating temperature (° C.) before blooming | Cooling rate (° C./sec.) in 1,300° C.-1,100° C. | Coiling temperature (° C.) at rolling | Cooling rate (° C./sec) after coiling | Pearlite area ratio (%) | BN-system compound grain number (pieces) 100 nm or more, less than 1,000 nm | BN-system compound grain number (pieces) 1,000 nm or more |
|---|---|---|---|---|---|---|---|---|
| 21 | A | 1103 | — | 926 | 21 | 96 | 126 | 3 |
| 22 | C | 1064 | — | 939 | 30 | 98 | 116 | 5 |
| 23 | E | 1099 | — | 903 | 35 | 99 | 26 | 13 |
| 24 | I | 1063 | — | 917 | 17 | 100 | 131 | 5 |
| 25 | J | 1088 | — | 926 | 23 | 100 | 128 | 6 |
| 26 | L | 1084 | — | 905 | 30 | 100 | 116 | 11 |
| 27 | O | 1063 | — | 911 | 21 | 98 | 28 | 16 |
| 28 | Q | 1077 | — | 920 | 31 | 100 | 24 | 13 |
| 29 | S | 1069 | — | 926 | 24 | 98 | 105 | 6 |
| 30 | A1 | 1311 | 0.9 | 897 | 13 | 97 | 38 | 0 |
| 31 | B1 | 1335 | 1.1 | 936 | 16 | 87 | 10 | 0 |
| 32 | C1 | 1329 | 2.6 | 894 | 27 | 96 | 32 | 1 |
| 33 | D1 | 1310 | 1.1 | 919 | 21 | 98 | — | — |
| 34 | E1 | 1305 | 0.9 | 900 | 30 | 100 | 16 | 0 |
| 35 | F1 | 1330 | 2.1 | 900 | 23 | 97 | 41 | 4 |
| 36 | G1 | 1321 | 1.2 | 909 | 35 | 97 | 15 | 1 |
| 37 | H1 | 1325 | 1.4 | 923 | 29 | 98 | 28 | 2 |
| 38 | I1 | 1304 | 1.5 | 917 | 31 | 100 | 119 | 3 |
| 39 | J1 | 1326 | 0.9 | 911 | 14 | 99 | — | — |
| 40 | K1 | 1306 | 1.1 | 901 | 34 | 100 | 21 | 1 |
| 41 | L1 | 1307 | 0.3 | 914 | 16 | 97 | 121 | 7 |
| 42 | M1 | 1306 | 0.4 | 931 | 30 | 100 | 112 | 11 |
| 43 | N1 | 1306 | 0.3 | 934 | 30 | 100 | 109 | 11 |

TABLE 5

| Test No. | Steel type | Heating temperature (° C.) before blooming | Heating Cooling rate (° C./sec.) in 1,300° C.-1,100° C. | Coiling temperature (° C.) at rolling | Cooling rate (° C./sec) after coiling | Pearlite area ratio (%) | BN-system compound grain number (pieces) 100 nm or more, less than 1,000 nm | BN-system compound grain number (pieces) 1,000 nm or more |
|---|---|---|---|---|---|---|---|---|
| 44 | B | 1316 | 2.5 | 929 | 7 | 76 | 61 | 2 |
| 45 | E | 1322 | 1.3 | 919 | 43 | 63 | 48 | 1 |
| 46 | I | 1326 | 1.6 | 970 | 18 | 81 | 51 | 4 |

[Measurement Method of Pearlite Area Ratio]

With regard to a pearlite area ratio, parts of a hot-rolled wire at the positions of the surface, D/4, and D/2 (D: a wire diameter) in a transverse section are embedded and polished, subjected to chemical corrosion with nital, and successively photographed in one visual field each at four parts forming an angle of 90 degrees between them with an optical microscope (at 400 magnifications in a region of 200 μm×200 μm). A picture image of an optical photomicrograph is printed out, white parts are blacked out with a black magic marker from over an overlapped transparency film (the white parts in a picture image of an optical photomicrograph are regarded as ferrite and lower bainite), successively the transparency film is taken into a personal computer with a scanner and the picture image is binarized with image analysis software (trade name "Image Pro Plus", made by Media Cybernetics, Inc.), successively a pearlite area ratio is obtained, and an average value is computed. Here, when a decarburized layer exists in a surface layer, a whole decarburized part stipulated in JIS G0058 is excluded from a measurement site.

[Measurement of Form of BN-System Compound]

Four parts forming an angle of 90 degrees between them of a hot-rolled wire at the position of D/4 (D: a wire diameter) in a transverse section are photographed in one visual field each (FE-SEM observation at 2,000 magnifications). Then one visual field is set at 2,000 $\mu m^2$, a picture image is binarized with image analysis software (trade name "Image Pro Plus", made by Media Cybernetics, Inc.), successively precipitates having equivalent circle diameters of 100 nm or more, less than 1,000 nm, and 1,000 nm or more are judged, and the composition of a BN-system compound is confirmed by EDX. Successively, the number of BN-system compound grains in each visual field is measured and an average number in four visual fields is computed.

[Trial Production of Steel Cord]

Each of the cast steels obtained by blooming is heated to 900° C. or higher to 1,100° C. or lower, successively subjected to hot rolling, and thereby a coil 5.5 mmϕ in diameter is obtained. The obtained coil is subjected to wiredrawing pretreatment by mechanical descaling and borax treatment and a wire 1.4 mmϕ in diameter is obtained by dry wiredrawing. Parts of the wires (Test Nos. 10-19 in Table 6 and Test Nos. 30, 38-40, and 43 in Table 7 shown below) are subjected to intermediate heat treatment by lead patenting at a diameter of 3.0 mmϕ during the dry wiredrawing process. Successively, final patenting by lead patenting and brass plating treatment are applied and a steel cord 0.18 mmϕ in diameter is produced experimentally by wet wiredrawing (linear speed: 500 m/min.) with a die having a die approach angle of 8 degrees.

With regard to each of the steel cords obtained through the above processes, fatigue strength is measured and wire drawability is judged by the following methods.

[Measurement of Fatigue Strength]

Fatigue strength is measured by applying fatigue test to each of the experimentally produced steel cords. A Hunter fatigue tester made by Bekaert Corporation is used as the Hunter fatigue tester, test stress a is set at 900-1,900 MPa, a Young's modulus is set at 196,200 MPa, and a sample length L (mm) and a chuck bushing C (mm) are decided from the expression (2) below. The test stress a is applied at the intervals of 50 MPa in the range of 900-1,900 MPa and 5 samples are tested at each test stress. The highest test stress at which all of the 5 samples have attained a rotation number of 10 million is regarded as the fatigue strength of the samples. Then the wire is judged to be excellent in fatigue strength when the value (fatigue strength/element wire strength) obtained by dividing the fatigue strength by an element wire strength (measured at a strain rate of 10 mm/min. with an autograph made by Shimadzu Corporation) is 0.35 or more. The Hunter fatigue test room is controlled at a room temperature of 20° C. and a humidity of 35%.

$$C=1.198\times E\times d/\sigma \quad (2)$$

Here, d: element wire diameter (mm), L=2.19×C+chuck insertion length (mm).

[Judgment of Wire Drawability]

Wire drawability is judged by applying twisting test to each of the experimentally produced steel cords (0.18 mmϕ in diameter). In the twisting test, a torsion tester made by Maekawa Testing Machine MFG. Co., Ltd. is used and GL (distance between chucks) is set at 50 mm. A steel cord having no longitudinal crack on a fracture face after breakage is judged as having a good wire drawability (σ) and a steel cord having a longitudinal crack is judged as having a poor wire drawability (x).

The results (element wire strength, fatigue strength, fatigue strength/element wire strength, and wire drawability) are shown in Tables 6, 7, and 8 below (Test Nos. 1-46) together with the steel types used.

TABLE 6

| Test No. | Steel type | Element wire strength (MPa) | Fatigue strength (MPa) | (Fatigue strength)/(element wire strength) | Wire drawability |
|---|---|---|---|---|---|
| 1 | A | 3526 | 1550 | 0.44 | ○ |
| 2 | B | 3550 | 1500 | 0.42 | ○ |
| 3 | C | 3869 | 1650 | 0.43 | ○ |
| 4 | D | 3748 | 1700 | 0.45 | ○ |
| 5 | E | 3791 | 1600 | 0.42 | ○ |
| 6 | F | 4681 | 1750 | 0.37 | ○ |
| 7 | G | 4140 | 1650 | 0.40 | ○ |
| 8 | H | 4296 | 1700 | 0.40 | ○ |
| 9 | I | 4288 | 1750 | 0.41 | ○ |
| 10 | J | 4361 | 1700 | 0.39 | ○ |
| 11 | K | 4488 | 1750 | 0.39 | ○ |
| 12 | L | 4419 | 1750 | 0.40 | ○ |
| 13 | M | 4420 | 1750 | 0.40 | ○ |

TABLE 6-continued

| Test No. | Steel type | Element wire strength (MPa) | Fatigue strength (MPa) | (Fatigue strength)/(element wire strength) | Wire drawability |
|---|---|---|---|---|---|
| 14 | N | 4864 | 1900 | 0.39 | ○ |
| 15 | O | 4411 | 1800 | 0.41 | ○ |
| 16 | P | 4618 | 1800 | 0.39 | ○ |
| 17 | Q | 4759 | 1850 | 0.39 | ○ |
| 18 | R | 4618 | 1850 | 0.40 | ○ |
| 19 | S | 4868 | 1900 | 0.39 | ○ |
| 20 | T | 4620 | 1800 | 0.39 | ○ |

TABLE 7

| Test No. | Steel type | Element wire strength (MPa) | Fatigue strength (MPa) | (Fatigue strength)/(element wire strength) | Wire drawability |
|---|---|---|---|---|---|
| 21 | A | 3328 | 850 | 0.26 | ○ |
| 22 | C | 3822 | 1000 | 0.26 | x |
| 23 | E | 3611 | 900 | 0.25 | ○ |
| 24 | I | 4221 | 1050 | 0.25 | x |
| 25 | J | 4318 | 1050 | 0.24 | x |
| 26 | L | | Not drawable | | |
| 27 | O | 4310 | 1000 | 0.23 | x |
| 28 | Q | | Not drawable | | |
| 29 | S | 4683 | 1100 | 0.23 | x |
| 30 | A1 | | Not drawable | | |
| 31 | B1 | 2713 | 850 | 0.31 | ○ |
| 32 | C1 | | Not drawable | | |
| 33 | D1 | 3561 | 1000 | 0.28 | ○ |
| 34 | E1 | | Not drawable | | |
| 35 | F1 | 3917 | 1200 | 0.31 | x |
| 36 | G1 | 3897 | 1150 | 0.30 | x |
| 37 | H1 | 4127 | 1250 | 0.30 | x |
| 38 | I1 | 4351 | 1200 | 0.28 | x |
| 39 | J1 | 4284 | 1150 | 0.27 | x |
| 40 | K1 | | Not drawable | | |
| 41 | L1 | 3780 | 1100 | 0.29 | x |
| 42 | M1 | 4014 | 1150 | 0.29 | x |
| 43 | N1 | 4408 | 1100 | 0.25 | x |

TABLE 8

| Test No. | Steel type | Element wire strength (MPa) | Fatigue strength (MPa) | (Fatigue strength)/(element wire strength) | Wire drawability |
|---|---|---|---|---|---|
| 44 | B | | Not drawable | | |
| 45 | E | | Not drawable | | |
| 46 | I | | Not drawable | | |

The results can be discussed as follows (here, a No. below represents a Test No. in Tables 6, 7, and 8). Nos. 1-20 are cases of satisfying the requirements stipulated in the present invention and it is obvious that a chemical composition and the form of BN-system compound grains (size and number) are controlled appropriately (Table 3 described earlier) and wire drawability and fatigue properties after wiredrawing are good.

In contrast, Nos. 21-43 are cases of deviating from any one of the requirements stipulated in the present invention (Table 4) and at least any one of the properties is inferior. Among the cases, in Nos. 21-29, although a chemical composition satisfies the requirements stipulated in the present invention, a heating temperature before blooming is low, the form of a BN-system compound is not appropriately controlled, and at least a good fatigue strength is not obtained. In Table 7 here, the description "not drawable" means that breakage (wire breakage) occurs at the stage of experimentally producing a steel cord (consequently, element wire strength, fatigue strength, etc. are not evaluated).

No. 30 is a case where the C content exceeds the range stipulated in the present invention and breakage occurs during wiredrawing (not drawable). No. 31 is a case where the C content is lower than the range stipulated in the present invention, the pearlite area ratio is not 90% or more, work hardenability deteriorates, and a good fatigue strength is not obtained.

No. 32 is a case where the Si content exceeds the range stipulated in the present invention, the ductility of ferrite in pearlite deteriorates, the wiredrawing limit lowers, and breakage occurs during wiredrawing (not drawable). In No. 33, B is not contained, fine BN-system compound grains do not precipitate, and hence the fatigue strength deteriorates.

No. 34 is a case where the Mn content is excessive, martensite and bainite are generated at an Mn segregated part, the wiredrawing limit lowers, and breakage occurs during wiredrawing (not drawable). No. 35 is a case where the P content is excessive and both the fatigue strength and the wire drawability deteriorate.

No. 36 is a case where the S content is excessive and both the fatigue strength and the wire drawability deteriorate. No. 37 is a case where the Al content is excessive, alumina system nonmetallic inclusions are generated, and both the fatigue strength and the wire drawability deteriorate.

No. 38 is a case where the B content is excessive, BN-system compound grains precipitate abundantly, and hence both the fatigue strength and the wire drawability deteriorate. In No. 39, B is not contained, fine BN-system compound grains do not precipitate, and hence both the fatigue strength and the wire drawability deteriorate. No. 40 is a case where the N content is excessive, the expression (1) is not satisfied, hence aging embrittlement is caused conspicuously, the fatigue strength deteriorates, and wire breakage occurs during wiredrawing (not drawable).

In Nos. 41-43, a cooling rate is not appropriate in the temperature range of 1,300° C.-1,100° C., hence the form of a BN-system compound is not controlled appropriately, and both the fatigue strength and the wire drawability deteriorate.

Nos. 44-46 are cases where a chemical composition satisfies the requirements stipulated in the present invention and a heating temperature before blooming and a cooling rate in the temperature range of 1,300° C.-1,100° C. are appropriate. In Nos. 44 and 45 however, although a coiling temperature at rolling is within the stipulated range of 850° C. or higher to 950° C. or lower, a cooling rate after coiling deviates from the stipulated range of 10° C./sec to 35° C./sec, a pearlite area ratio is not 90% or more, and both the fatigue strength and the wire drawability deteriorate. In No. 46, although the cooling rate after coiling is within the stipulated range of 10° C./sec to 35° C./sec, the coiling temperature at rolling exceeds the stipulated range of 850° C. or higher to 950° C. or lower, a pearlite area ratio is not 90% or more, and both the fatigue strength and the wire drawability deteriorate.

The invention claimed is:

1. A steel wire comprising iron and, by mass % based on a total mass of the steel wire:

C: 0.70%-1.20%;

Si: 0.1%-1.5%;

Mn: 0.1%-1.5%;

P: 0.015% or less not including 0%;

S: 0.015% or less not including 0%;

Al: 0.005% or less not including 0%;

B: 0.0005%-0.010%;

N: 0.002%-0.005%; and solid solution N: 0.0015% or less including 0%, wherein an area ratio of a pearlite structure is 90% or more, and in a pearlite structure of 2,000 $\mu m^2$, the number of BN-system compound grains having an equivalent circle diameter of 100 nm or more to less than 1,000 nm is not more than 100 pieces including 0 piece and the number of BN-system compound grains having an equivalent circle diameter of 1,000 nm or more is not more than 10 pieces including 0 piece.

2. The steel wire of claim 1, further comprising, by mass % based on a total mass of the steel wire:

Cu: 0.25% or less not including 0%.

3. The steel wire of claim 1, further comprising, by mass % based on a total mass of the steel wire:

Cr: 1.0% or less not including 0%.

4. The steel wire of claim 2, further comprising, by mass % based on a total mass of the steel wire:

Cr: 1.0% or less not including 0%.

5. The steel wire of claim 1, wherein the area ratio of the pearlite structure is 93% or more.

6. The steel wire of claim 1, wherein in a pearlite structure of 2,000 $\mu m^2$, the number of BN-system compound grains having an equivalent circle diameter of 100 nm or more to less than 1,000 nm is not more than 70 pieces including 0 piece.

7. The steel wire of claim 1, wherein in a pearlite structure of 2,000 $\mu m^2$, the number of BN-system compound grains having an equivalent circle diameter of 1,000 nm or more is not more than 7 pieces including 0 piece.

8. The steel wire of claim 6, wherein in a pearlite structure of 2,000 $\mu m^2$, the number of BN-system compound grains having an equivalent circle diameter of 1,000 nm or more is not more than 7 pieces including 0 piece.

9. The steel wire of claim 1, wherein the content of C in the steel wire is from 0.75%-1.15% by mass.

10. The steel wire of claim 1, wherein the content of Si in the steel wire is from 0.15%-1.4% by mass.

11. The steel wire of claim 1, wherein the content of Mn in the steel wire is from 0.2%-1.4% by mass.

12. The steel wire of claim 1, wherein the content of P in the steel wire is 0.01% or less by mass not including 0%.

13. The steel wire of claim 1, wherein the content of S in the steel wire is 0.01% or less by mass not including 0%.

14. The steel wire of claim 1, wherein the content of Al in the steel wire is 0.003% or less by mass not including 0%.

15. The steel wire of claim 1, wherein the content of B in the steel wire is from 0.002%-0.008% by mass.

16. The steel wire of claim 1, wherein the content of N in the steel wire is from 0.002%-0.0045% by mass.

17. The steel wire of claim 2, wherein the content of Cu in the steel wire is from 0.03%-0.23% by mass.

18. The steel wire of claim 3, wherein the content of Cr in the steel wire is from 0.03%-0.8% by mass.

19. The steel wire of claim 17, wherein the content of Cr in the steel wire is from 0.03%-0.8% by mass.

20. The steel wire of claim 1, wherein the content of Al in the steel wire is 0.004% or less by mass not including 0%.

* * * * *